US006796744B2

(12) United States Patent
Jacoway et al.

(10) Patent No.: US 6,796,744 B2
(45) Date of Patent: Sep. 28, 2004

(54) INTERNAL COMPRESSION BUOYANCY COMPENSATION DEVICE

(75) Inventors: William W. Jacoway, San Diego, CA (US); Robert B. Jacoway, Poway, CA (US); John Modugno, Torrance, CA (US)

(73) Assignee: Deepoutdoors, Inc., Poway, CA (US)

( * ) Notice: Subject to any disclaimer, the term of this patent is extended or adjusted under 35 U.S.C. 154(b) by 0 days.

(21) Appl. No.: 10/377,450

(22) Filed: Feb. 28, 2003

(65) Prior Publication Data

US 2003/0181108 A1 Sep. 25, 2003

Related U.S. Application Data

(60) Provisional application No. 60/360,998, filed on Mar. 1, 2002.

(51) Int. Cl.[7] ..... B63C 11/02; B63C 9/08
(52) U.S. Cl. ..... 405/186; 441/106
(58) Field of Search ..... 405/186; 441/106, 441/111, 112

(56) References Cited

U.S. PATENT DOCUMENTS 4,035,897 A 7/1977 Over et al.
4,752,263 A * 6/1988 Pritchard et al. ..... 114/88
5,403,123 A 4/1995 Walters
5,522,679 A 6/1996 Eungard
5,551,800 A 9/1996 Hobelsberger
5,785,567 A 7/1998 Modugno
5,980,158 A 11/1999 Griffiths et al.

OTHER PUBLICATIONS

Custom Divers, http://www.customdivers.com/specs/tcw_wing.pdf (1 page), (printed May 8, 2003).

* cited by examiner

*Primary Examiner*—Heather Shackelford
*Assistant Examiner*—Lisa M. Saldano
(74) *Attorney, Agent, or Firm*—Gordon & Rees LLP

(57) ABSTRACT

An internal compression buoyancy compensation device is provided with at least one bladder and a plurality of pairs of internal compression straps. Expansion of the deflated or partially inflated buoyancy compensation device is restrained by the internal elastic compression straps designed for even distribution of gas, a streamlined and low profile, and a reduced risk of entanglement on external objects.

25 Claims, 3 Drawing Sheets

INTERNAL COMPRESSION BUOYANCY COMPENSATION DEVICE

This application claims benefit of 60/360,998 filed on Mar. 1, 2002.

BACKGROUND

This invention concerns underwater diving, specifically a buoyancy control device to be used when SCUBA diving.

A buoyancy compensation device is a device used by divers to adjust their buoyancy during a dive. Specifically, the buoyancy compensation device is typically used to maintain neutral buoyancy in the water or to keep the diver afloat while on the surface of the water. As a diver descends in the water, the pressure change results in a change in buoyancy of the diver, particularly when a diver is wearing a neoprene wetsuit. As the water pressure increases, the air trapped within the neoprene compresses, resulting in a decrease in buoyancy. Therefore, the deeper a diver descends, the less buoyant the diver becomes. Additionally, a diver's buoyancy will be affected by weight loss as the diver consumes the breathable gas from the air tank.

A buoyancy compensation device typically has one or more air bladders that can be inflated with air to offset the loss of buoyancy and at least one overpressure relief valve. Also, a typical buoyancy compensation device generally has one or more valves that can be used to inflate the buoyancy compensation device, either manually or via a hose attached to the air tank, or to deflate the buoyancy compensation device by allowing air to escape from a valve.

The inflation of such buoyancy compensation devices often results in uneven gas distribution, creating a bulge in the part of the buoyancy compensation device closest to the surface. This resulting bulge may be uncomfortable for the diver as well as create excess drag in the water due to the unnecessarily high profile of a portion of the buoyancy compensation device.

As a result, several attempts employing varying methods to control the shape and expansion of the buoyancy compensation devices have evolved to solve these issues. The majority of these previous attempts of buoyancy compensation devices include compression straps or bands around the outer periphery of the buoyancy compensation device to restrain the air bladder of the buoyancy compensation device. When the buoyancy compensation device is deflated or inflated, the compression straps or bands aid in uniformly distributing the air within the buoyancy compensation device.

However, the disadvantages of the external placement of the straps or bands include the possibility of entangling or snagging the compression straps on other objects, both while in the water and while moving gear on the surface, such as fishing line, kelp, projections on submersed wrecks as well as when diving in caves, reefs or environments with abrasive or protruding surfaces. In the event one of these external compression straps or bands becomes entangled on an external object, the diver may be required to cut these external compression straps or bands to release themselves. Depending on how many external compression straps or bands are severed, a potentially uneven gas bulge of the buoyancy compensation device may result, as mentioned above. Further, cutting a strap would obviously necessitate the replacement of the now severed compression strap. Also, wielding a cutting object so close to the bladder also runs the risk of puncturing the bladder when attempting to sever an entangled compression strap, rendering the bladder potentially useless. Additionally, the useable life of external compression straps or bands may be further shortened by exposure to harsh environments when not in use, including transport in a vehicle trunk with exposed mental edges or other storage environments as well as subjecting the straps or bands to sunlight. Despite these drawbacks, many examples of external compression straps are currently sold and used for diving.

Recent prior attempts of buoyancy compensation devices to avoid the shortcomings of external compression methods include an elasterometric material to comprise the entire buoyancy compensation device. However, gas tends to fill the areas of the buoyancy compensation devices closest to the surface, regardless of the orientation of the diver, thus, if the buoyancy control device is inflated before the elastic compresses the volume, a bulge may again result subjecting the buoyancy control device to the same shortcomings as previously mentioned.

Other recent prior attempts have included internal structures designed to control the shape and size of an inflated buoyancy compensation device. The reduction in both shape and size is often accomplished by use of nonelastic material for the sole purpose to better fit the buoyancy compensation device to the diver by avoiding a rounded, balloon shape or a planar shape. One buoyancy compensation device in the shape of an elongate, accordion bellow-shaped bag that may contain internal elastic straps or metal springs to control linear expansion is taught in U.S. Pat. No. 5,551,800 to Hobelsbergern. The diver is meant to attach the elongate bag to the diving equipment, but not necessarily wear the elongate bag. Such an elongate bag may become tangled in fishing line, kelp, caves, sunken wrecks or many other hazards with the risk of entanglement increasing with the length of the elongate bag.

In sum, all current internal compression methods accomplish only one of the following: aid in control and even deflation, enable use of lower inflation pressures for wave impacts, or restrain the size of the inflated buoyancy compensation device. Currently, no buoyancy compensation device provides uniformity of air distribution, maintains a low profile during inflation and deflation, and aids in deflation by an internal-compression means. An obvious need exists for a buoyancy control device that contains internal compression straps that aid in deflation, evenly distribute air throughout the buoyancy compensation device, and maintain a low and streamlined buoyancy compensation device profile with these internal compression straps for both added longevity of the compression means as well as for increased diver safety.

SUMMARY OF THE INVENTION

It is therefore the object of the present invention to provide a buoyancy compensation device with an internal compression strap system.

It is another object of the present invention to overcome the limitations inherent in buoyancy compensation devices as listed above.

A further object of the present invention is to aid in deflation of the buoyancy compensation device bladder.

Yet another object of the present invention is to maintain a streamline and low profile of the buoyancy compensation device at various bladder volumes.

A further object of the present invention is to reduce drag in the water with internal elastic compression straps.

It is yet another object of the present invention to increase the life of the internal elastic compression straps by reducing wear due to exposure and hazards.

Another object of the present invention to reduce the risk of entanglement or snags on external hazards, including, but not limited to such items as kelp, fishing lines and parts of a sunken wreck.

Yet a further object of the present invention is to provide greater comfort and freedom of movement to the diver.

The internal compression buoyancy compensation device is comprised of at least one bladder within a bladder structure surrounded by a protective housing. Internal compression straps aid in deflation, evenly distribute air throughout the buoyancy compensation device, maintain a low and streamlined buoyancy control device profile, extend the lifetime of the internal compression straps, and increase diver safety. The internal compression straps may be made of any resilient elastic material, such as, but not limited to, silicone, rubber, or similar material. Although referred to as a "strap" herein, the compression means can include various shapes and sizes and should not be limited by use of the aforementioned terms. Preferably, the internal compression straps are placed within a protective sleeve. The protective sleeve can include, but is not limited to, a piece of material sewn to the interior surface of the protective housing so that the internal compression straps are prevented from rubbing against the gas bladder structure.

These and other features, aspects, and advantages of the present invention will become better understood with regard to the following description, appended claims, and accompanying drawings.

DETAILED DESCRIPTION OF THE PREFERRED EMBODIMENTS

The invention is an internal compression buoyancy compensation device 1 for use in diving. The invention is designed to contain internal elastic compression straps 2 that aid in deflation, evenly distribute gas throughout the buoyancy compensation device, and maintain a low and streamlined buoyancy compensation device profile. The internal elastic compression straps also provide for added longevity of the elastic compression straps as well as for increased diver safety.

Figure 1:
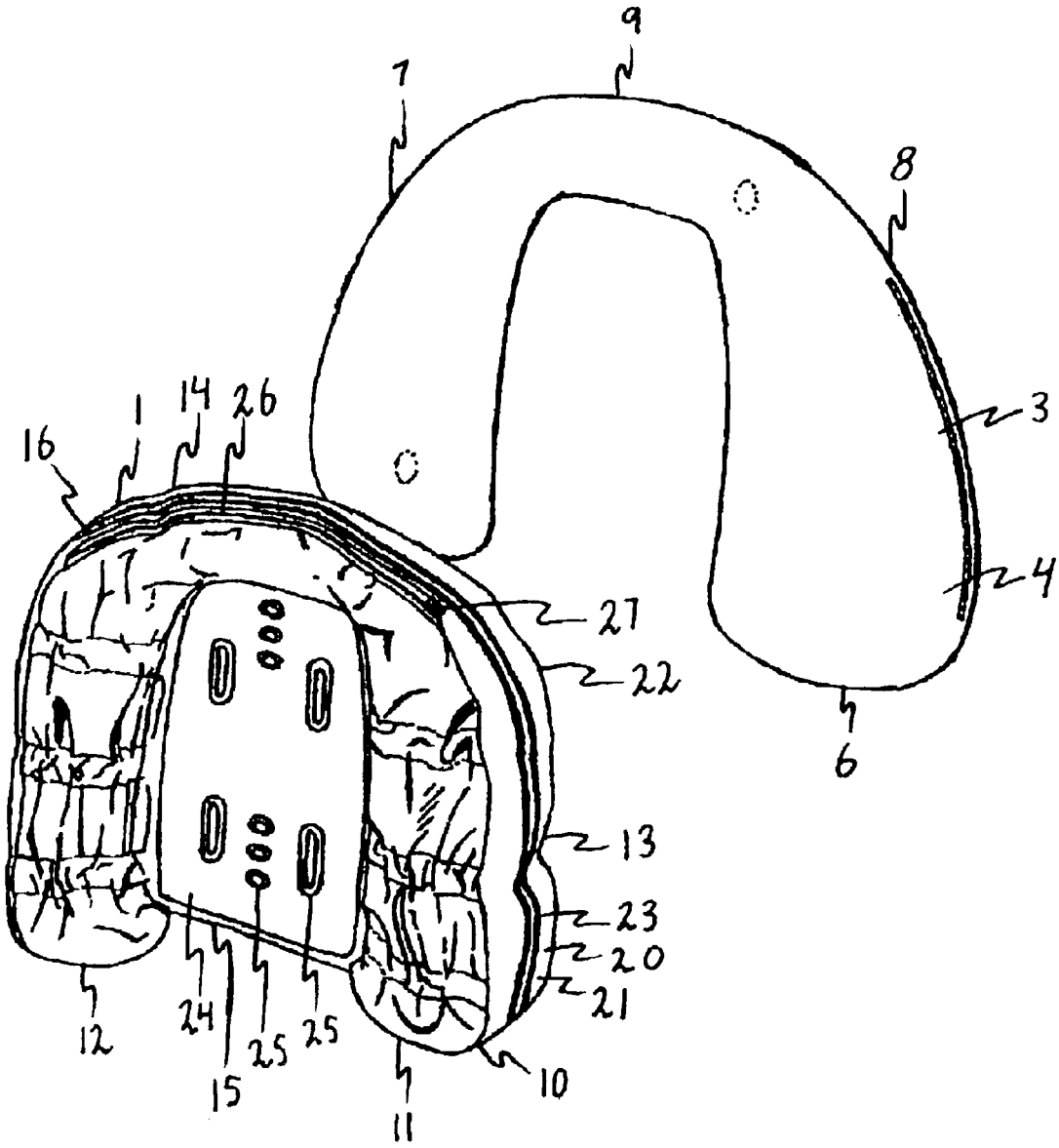
FIG. 1 shows the buoyancy compensation device from the back, showing the location of the compression straps and the bladder structure.
Figure 3:
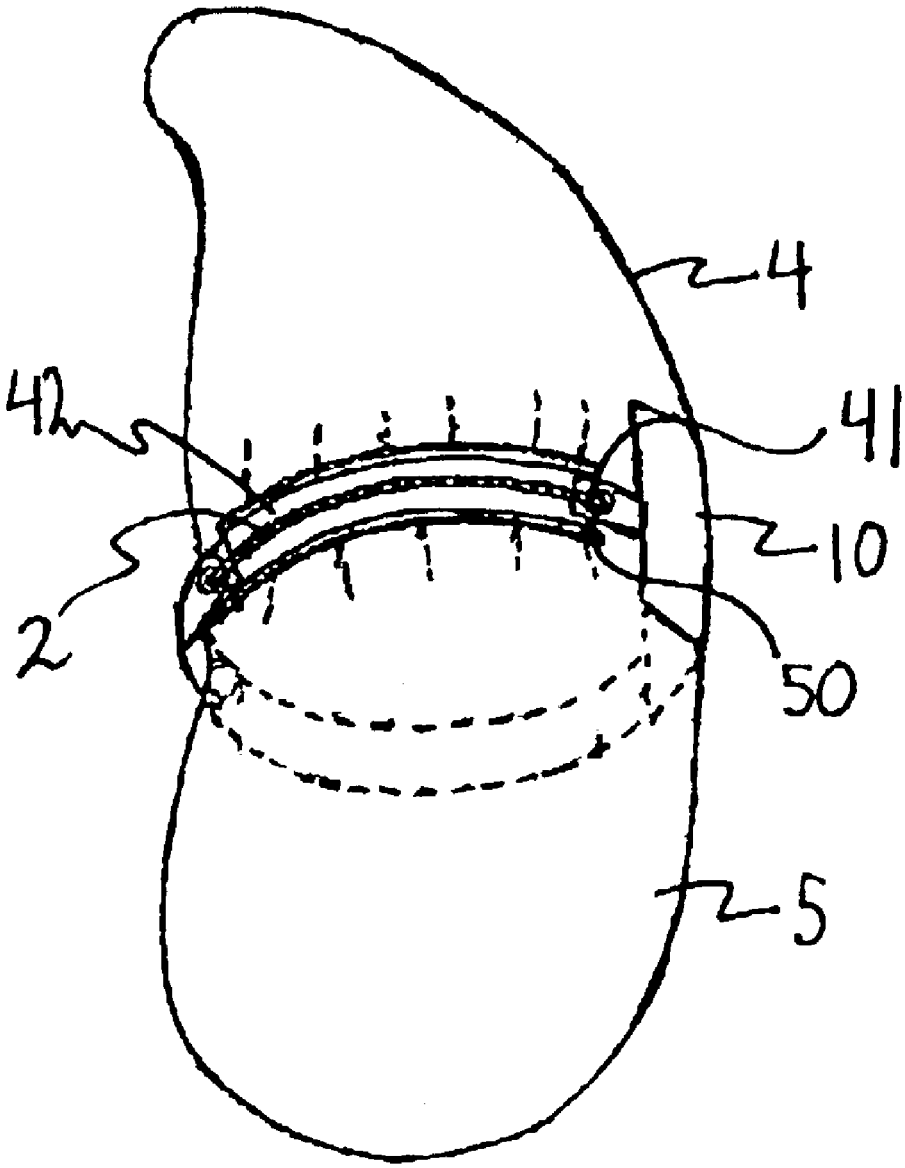
FIG. 3 shows one member of a complementary pair of compression straps attached to the inside of the protective housing.

Referring to FIGS. 1 and 3, a buoyancy compensation device 1 has a bladder structure 3 with at least one bladder 4 composed of a gas chamber 5 that is designed to be inflated and deflated. The bladder structure may comprise a plurality of gas chambers. Preferably, the bladder structure comprises a U-shape 6, with a first generally linear portion 7 and a second generally linear portion 8 connected by a curvalinear portion 9 to form the U shape. A protective housing 10 surrounding the bladder is preferably made from a suitable high-strength fabric or material such as, but not limited to, woven nylon. The protective housing preferably is a U-shape 11 that corresponds with the U-shape 6 of the bladder structure, including a first generally linear portion 12 and a second generally linear portion 13 and a connecting curvilinear portion 14 covering the corresponding portions of the bladder structure. The U-shape of the protective housing has an inside portion 15 partially enclosed by the linear portions of the U-shape and an outside portion 16.

The protective housing may contain a portion of resilient elastic material 20. The elastic portion of the protective housing preferably comprises a band of elastic material 21 about the periphery 22 of the outside portion of the U-shape of the protective housing. Further, a strip of reflective material 23 may be affixed about this band of elastic material of the protective housing. A semi-rigid backplate 24 with various slots 25, preferably attached to the protective housing, is designed to aid in attachment to other equipment.

Access to the bladder structure 3 is provided through an opening 26 in the protective housing 10 without the need to remove any of the compressing means 2. The opening in the protective housing is preferably secured with a zipper 27, but may comprise a hook and loop fastener, buttons or other suitable fastening means.

Figure 2:
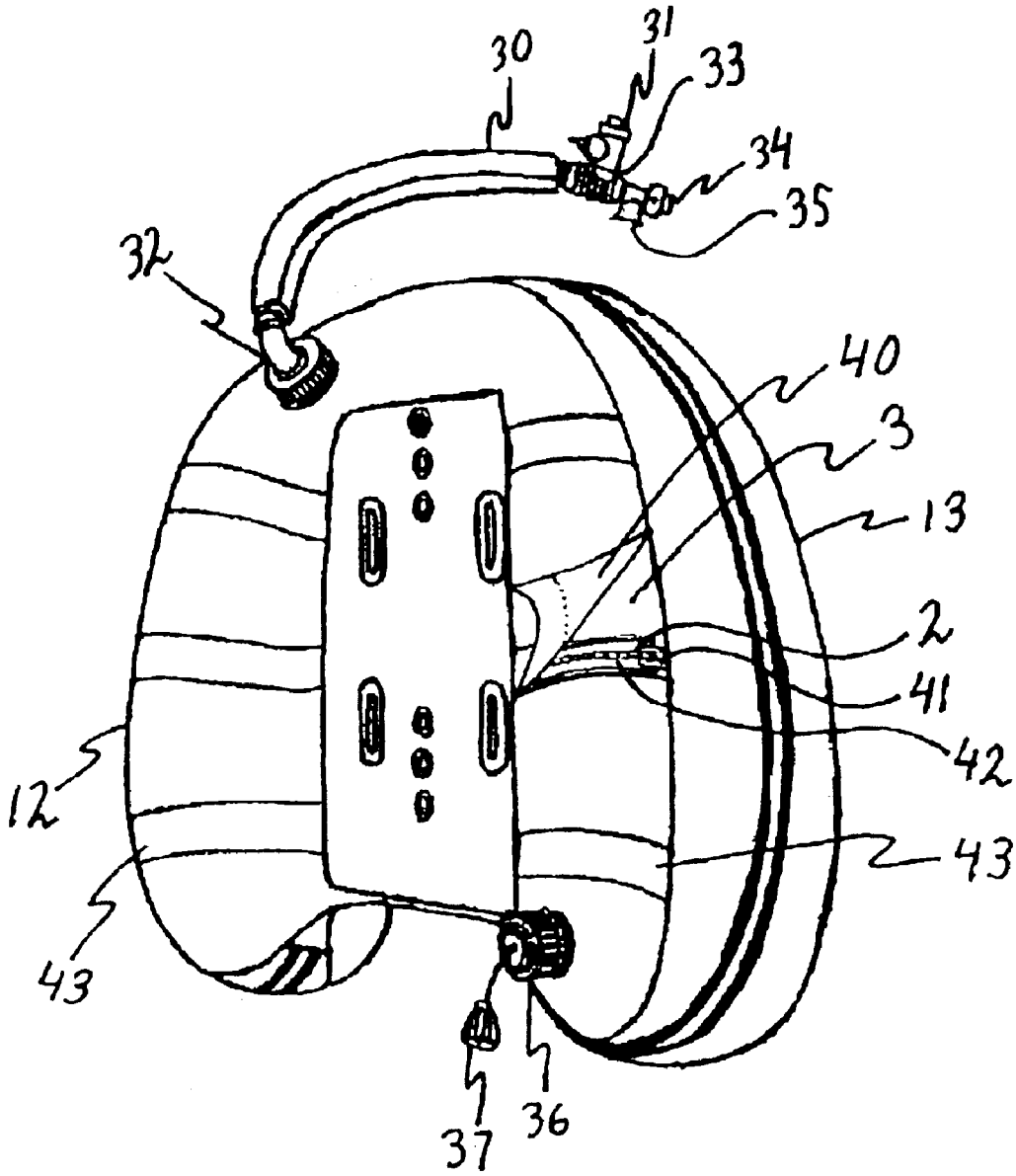
FIG. 2 shows the buoyancy compensation device from the front, showing the internal location of the compression straps.

Referring now to FIG. 2, at least one hose 30 with at least one valve assembly 31 is connected to the bladder structure 3 and extends beyond the protective housing 10 to inflate and deflate the bladder structure. A version of the bladder structure that comprises two independent bladders would contain two hose and valve assemblies, whereas another version of the bladder structure that comprises one bladder 4 would contain one hose 30 and valve assembly 31. The end of the hose opposite the bladder structure connection site 32 is attached to both a valve regulator 33 that can be used to inflate the bladder structure as well as a valve 34 that can be used to either deflate the bladder structure or allow for manual inflation through the attached mouth piece 35. The buoyancy compensation device further includes at least one over-pressurization relief valve 36 attached to the bladder structure that can also be manually activated using the attached pull cord 37.

The protective housing also has an internal surface 40 that contacts the bladder structure 3 and an external surface 10 opposing the inside surface and does not contact the bladder structure. A plurality of resilient elastic compression straps 2 are attached to the internal surface of the protective housing 10 and at least partially circumscribe the bladder structure. The ends of the elastic compression straps 41 are attached, preferably sewn, on the inside surface of the protective housing 42 such that both ends of the elastic compression straps are attached, resulting in the elastic compression straps remaining in a fixed location. Preferably, the elastic compression straps are in pairs 43, each pair generally perpendicular to the linear portions but planar to each other, designed so that one band of the pair at least partially circumscribes the first linear portion 12 and the second band of the pair at least partially circumscribes the corresponding second linear portion 13, providing symmetric compression of the bladder structure. The complementary pairs 43 of compressing means may be equally spaced or concentrated in specific areas to effect the desired compression of the bladder and the corresponding compression of the protective coating. The total number of elastic compression straps may vary, but the preferred number is either six or eight.

Referring now to FIGS. 2 and 3, the protective housing comprises at least one internal structure 42, preferably a sleeve compartment with two open ends, designed to prohibit direct contact between the elastic compression straps 2 and the bladder structure 3. The internal structure 42, preferably a sleeve compartment, consists of material placed over the elastic compression straps and attached 50 to the protective housing 10.

The previously described versions of the present invention have many advantages, including the ability to aid in deflation of the bladder structure. The advantages of the aid in deflation may include an option for more rapid deflation.

Another advantage related to the deflation and inflation of the bladder structure is the even volume distribution within the bladder structure. The internal compression straps and optionally the elastic band about the periphery of the protective housing are designed to aid in even volume distribution during changes in inflation and deflation as well as during periods of a constant volume. The even distribution of volume in the bladder structure prohibits the formation of bulges due to inconsistent distribution of gas within the bladder structure.

Yet another advantage of the present invention is the consistent maintenance of a low and streamlined buoyancy compensation device profile, especially at a partially inflated state. Maintenance of a low profile of the buoyancy compensation device provides greater comfort for the diver. Also, a low profile helps to reduce drag due to water resistance. Finally, a low profile may be extremely useful when a diver is moving past a small opening, such as during a dive in a sunken wreck, reef or cove.

A further advantage of the present invention includes the benefits of moving the elastic compression straps internally. The protective housing of the bladder structure, designed of a durable material to withstand wear and tear, therefore also serves to protect the elastic compression strands. Needless to say, the wear and tear of the elastic compression straps is reduced and therefore, the expected useable lifetime of the elastic compression straps is extended as compared to those compression straps that are exposed to such hazards as sunlight, abrasion, or lacerations.

Another advantage of the use of independent elastic compression straps provides continued compression in the event that one or more of the elastic compression straps is severed or loses integrity as compared to a single compression strap. The remaining elastic compression straps would still provide compression. The low profile and avoidance of a bulge should still generally be avoided if only a few elastic compression straps are removed, especially if the sides of the protective housing include an elastic band.

A further advantage of moving the elastic compression straps to the interior of the protective housing is increased diver safety. Moving the elastic compression straps internally eliminates the possibility of snagging the compression straps on other objects, both while in the water and while moving gear on the surface. Internalizing the elastic compression straps, therefore, should primarily eliminate the circumstances when a diver would be required to cut the compression straps to free themselves of an entanglement. Consequently, the circumstances when the diver may be required to reach around behind their back to free themselves by cutting entangled compression straps, risking puncturing the bladder or damaging other necessary diving equipment, are greatly reduced if not eliminated.

Thus, the problems that may be associated with some previous attempts at buoyancy compensation devices that do not evenly distribute volume, maintain a low profile, nor internalize compression means are solved. It is important to note, however, that the invention does not require that all these advantages need be incorporated into every embodiment of the invention.

An embodiment of the buoyancy compensation device comprises at least one gas bladder enclosed within a protective housing and a plurality of independent elastic compression straps attached to the inner surface of the protective housing.

Another embodiment of the buoyancy compensation device comprises at least one gas bladder enclosed within a protective housing that incorporates an elastic side panel as well as a plurality of independent elastic compression straps attached to the inner surface of the protective housing.

Yet another embodiment of the buoyancy compensation device comprises at least one gas bladder enclosed with a protective housing that incorporates an elastic side panel as well as independent elastic compression straps that are arranged in pairs, preferably three or four pair, each pair having one band on each one of the two corresponding elongate linear sections of a "U"-shaped bladder structure.

Yet a further embodiment of the buoyancy compensation device comprises at least one gas bladder enclosed with a protective housing that incorporates an elastic side panel band as well as independent elastic compression straps that are arranged in pairs, preferably three or four pair, wherein each internal elastic compression strap does not form a continuous loop, each pair having one strap on each one of the two corresponding elongate linear sections of the U-shape of the bladder structure, but each of the two ends of each strap terminate at an elastic sidewall band of the buoyance compensation device. The internal elastic compression straps, in conjunction with the elastic sidewall band of the buoyancy compensation device, effectively circumscribe the elongate linear portions of the internal bladder with elastic material.

Although the present invention has been described in considerable detail with reference to certain preferred versions thereof, other embodiments or versions are possible. For example, all of the features disclosed in this specification and drawings may be replaced by alternative features serving the same, equivalent or similar purpose, unless expressly stated otherwise. Therefore, the spirit and scope of the specification should not be limited to the description of the preferred versions contained herein.

We claim:

1. An internal compression buoyancy compression device comprising an inflatable and deflatable bladder structure at least partially circumscribed by resilient elastic material, said resilient elastic material at least partially contained within elastic compression straps, with a protective housing covering both said bladder structure and said elastic compression straps, said protective housing attached to a backplate structure and wherein said protective housing comprises at least one internal structure designed to prohibit direct contact between said elastic compression straps and said bladder structure.

2. An internal compression buoyancy compensation device comprising:

a. a bladder structure, said bladder structure having at least one bladder having a gas chamber, said bladder structure being designed to be inflated and deflated with gas;

b. a protective housing surrounding said bladder structure, said protective housing having an internal surface in contact with said bladder structure and an external surface opposing said internal surface, said external surface not in contact with said bladder structure;

c. at least one hose with a resealable valve assembly connected to said bladder structure, said hose extending beyond said protective housing and designed to inflate and deflate said bladder structure with gas;

d. at least one valve assembly connected to said bladder structure for releasing gas from said bladder structure, said valve assembly extending beyond said protective housing; and e. a plurality of resilient elastic compression straps attached to said internal surface of said protective housing, and said elastic compression straps at least partially circumscribing said bladder structure.

3. The internal compression buoyancy compensation device of claim 2 wherein said protective housing comprises at least one internal structure designed to prohibit direct contact between said elastic compression straps and said bladder structure.

4. The internal compression buoyancy compensation device of claim 3 wherein said bladder structure further comprises a U-shape, with a first and a second generally linear portion connected by a curvilinear portion connecting said first and second linear portions.

5. The internal compression buoyancy compensation device of claim 4 wherein said protective housing further comprises said U-shape of said bladder structure, said U-shape of said protective housing having an inside portion partially enclosed by said linear portions of said U-shape and an outside portion.

6. The internal compression buoyancy compensation device of claim 5 wherein said outside portion of said protective housing further comprises a resilient elastic band portion.

7. The internal compression buoyancy compensation device of claim 6 wherein said resilient elastic band portion further comprises a strip of reflective material.

8. The internal compression buoyancy compensation device of claim 5 wherein said plurality of elastic compression straps further comprises pairs, each said pair generally perpendicular to said linear portions and designed such that one band of said pair at least partially circumscribes and first linear portion and the second band of said pair at least partially circumscribes said second linear portion.

9. The internal compression buoyancy compensation device of claim 8 wherein said elastic compression straps comprise a number selected from a group consisting of six or eight.

10. The internal compression buoyancy compensation device of claim 2 further comprising a semi-rigid backplate attached to said protective housing, said backplate having various slots designed to aid in attachment to other equipment.

11. A internal compression buoyancy compensation device comprising:

a. a bladder structure, said bladder structure having at least one bladder having a gas chamber, said bladder structure being designed to be inflated and deflated with gas;

b. a protective housing surrounding said bladder structure, at least a portion of said protective housing being a resilient elastic material and said protective housing having an internal surface in contact with said bladder structure and an external surface opposing said internal surface, said external surface not in contact with said bladder structure;

c. at least one hose with a resealable valve assembly connected to said bladder structure, said hose extending beyond said protective housing and designed to inflate and deflate said bladder structure with gas;

d. at least one valve assembly connected to said bladder structure for releasing gas from said bladder structure, said valve assembly extending beyond said protective housing;

e. a plurality of resilient elastic compression straps attached to said internal surface of said protective housing, and said elastic compression straps at least partially circumscribing said bladder structure; and f. at least one internal structure attached to said protective housing, said internal structure designed to prohibit direct contact between said elastic compression straps and said bladder structure.

12. The internal compression buoyancy compensation device of claim 11 wherein said bladder structure further comprises a U-shape, with a first and a second generally linear portion connected by a curvalinear portion connecting said first and second linear portions.

13. The internal compression buoyancy compensation device of claim 12 wherein said protective housing further comprises said U-shape of said bladder structure, said U-shape of said protective housing having an inside portion partially enclosed by said linear portions of said U-shape and an outside portion.

14. The internal compression buoyancy compensation device of claim 13 wherein said plurality of elastic compression straps further comprises pairs, each said pair generally perpendicular to said linear portions and designed such that one strap of said pair at least partially circumscribes said first linear portion and the second strap of said pair at least partially circumscribes said second linear portion.

15. The internal compression buoyancy compensation device of claim 14 wherein said elastic compression straps comprise a number selected from a group consisting of six or eight.

16. The internal compression buoyancy compensation device of claim 12 wherein said protective housing elastic portion comprises a band of elastic material oriented about said outside portion of said U-shape of said protective housing.

17. The internal compression buoyancy compensation device of claim 16 further comprising a strip of reflective material about said band portion of said protective housing.

18. The internal compression buoyancy compensation device of claim 11, said bladder structure comprising a plurality of chambers.

19. The internal compression buoyancy compensation device of claim 11 further comprising a semi-rigid backplate attached to said protective housing, said backplate having various slots designed to aid in attachment to other equipment.

20. An internal compression buoyancy compensation device comprising an inflatable and deflatable bladder structure at least partially circumscribed by resilient material, said resilient material designed to aid in internal compression, with a protective housing covering both said bladder structure and said resilient material, said protective housing attached to a backplate structure and wherein said protective housing comprises at least one internal structure designed to prohibit direct contact between said resilient material and said bladder structure.

21. The internal compression buoyancy compensation device of claim 20 wherein said resilient material is contained within a sleeve.

22. The internal compression buoyancy compression device of claim 21 wherein said sleeve is designed to prohibit direct contact between said resilient material and said bladder structure.

23. An internal compression buoyancy compensation device comprising an inflatable and deflatable bladder structure at least partially circumscribed by resilient elastic material, with a protective housing covering both said bladder structure and said resilient elastic material, said protective housing attached to a backplate structure and wherein said protective housing comprises at least one internal structure designed to prohibit direct contact between said resilient elastic material and said bladder structure.

24. An internal compression buoyancy compensation device comprising:

a. a bladder structure, said bladder structure having at least one bladder having a gas chamber, said bladder structure being designed to be inflated and deflated with gas;

b. a protective housing surrounding said bladder structure, said protective housing having an internal surface in contact with said bladder structure and an external surface opposing said internal surface, said external surface not in contact with said bladder structure;

c. at least one hose with a resealable valve assembly connected to said bladder structure, said hose extending beyond said protective housing and designed to inflate and deflate said bladder structure with gas;

d. at least one valve assembly connected to said bladder structure for releasing gas from said bladder structure, said valve assembly extending beyond said protective housing;

e. a plurality of resilient elastic material attached to said internal surface of said protective housing, and said resilient elastic material least partially circumscribing said bladder structure.

25. The internal compression buoyancy compensation device of claim 24 wherein said protective housing comprises at least one internal structure designed to prohibit direct contact between said resilient elastic material and said bladder structure.

* * * * *